US005670474A

United States Patent [19]

Crawford et al.

[11] Patent Number: 5,670,474

[45] Date of Patent: Sep. 23, 1997

[54] HIGH PERFORMANCE DETERGENT POWDERS

[75] Inventors: Robert John Crawford, Wirral; Alastair Richard Sanderson, South Wirral, both of United Kingdom

[73] Assignee: Lever Brothers Company, Division of Conopco, Inc., New York, N.Y.

[21] Appl. No.: 565,533

[22] Filed: Nov. 30, 1995

[30] Foreign Application Priority Data

Dec. 2, 1994 [GB] United Kingdom ..... 9424444

[51] Int. Cl.[6] ..... C11D 3/22; C11D 3/32

[52] U.S. Cl. ..... 510/470; 510/356; 510/350; 510/361; 510/470; 510/502; 510/445; 510/509

[58] Field of Search ..... 510/356, 350, 510/361, 470, 502, 445, 509

[56] References Cited

U.S. PATENT DOCUMENTS

| | | | |
|---|---|---|---|
| 4,536,319 | 8/1985 | Payne | 252/174.17 |
| 5,318,728 | 6/1994 | Surutzidis et al. | 252/548 |
| 5,364,647 | 11/1994 | Hill et al. . | |
| 5,370,816 | 12/1994 | Balzer et al. | 252/132 |
| 5,389,279 | 2/1995 | Au et al. | 252/108 |
| 5,454,982 | 10/1995 | Murch et al. | 252/548 |
| 5,534,197 | 7/1996 | Scheibel et al. | 510/356 |

FOREIGN PATENT DOCUMENTS

| | | |
|---|---|---|
| 0070077A2 | 7/1982 | European Pat. Off. . |
| 0 070 077 | 1/1983 | European Pat. Off. . |
| 0 374 702 | 6/1990 | European Pat. Off. . |
| 0 474 915 | 3/1992 | European Pat. Off. . |
| 0550278A1 | 12/1992 | European Pat. Off. . |
| 0 550 278 | 7/1993 | European Pat. Off. . |
| 2 267 911 | 12/1993 | United Kingdom . |
| WO 91/02046 | 2/1991 | WIPO . |
| 92/06164 | 4/1992 | WIPO . |
| WO 92/06164 | 4/1992 | WIPO . |
| WO 93/19155 | 9/1993 | WIPO . |
| WO 93/23514 | 11/1993 | WIPO . |
| WO 95/07968 | 3/1995 | WIPO . |
| 95/07968 | 3/1995 | WIPO . |

OTHER PUBLICATIONS

International Search Report in International Patent Application PCT/EP 95/04443.

Abstract of WO 93/19155.

Abstract of WO 93/23514.

Abstract of EP 0 474 915.

Great Britain Search Report in Great Britain Patent Application No. 9424444.9.

*Primary Examiner*—Douglas J. McGinty

*Assistant Examiner*—Charles I. Boyer

*Attorney, Agent, or Firm*—Rimma Mitelman

[57] ABSTRACT

A built particulate detergent composition for fabric washing, containing not more than 10 wt. % of water-insoluble builder and not more than 10 wt. % of water, contains a high level (40–90 wt. %) of a nonionic surfactant component consisting wholly or predominantly of a nonionic surfactant solid at ambient temperature, for example, alkylpolyglycoside or lactobionamide. Liquid nonionic surfactant and other cosurfactants may be present in limited amounts. A detergency builder is also present, the ratio of builder to nonionic surfactant not exceeding 1:1.

22 Claims, No Drawings

HIGH PERFORMANCE DETERGENT POWDERS

TECHNICAL AREA

The present invention relates to compact high performance detergent powders for fabric washing.

BACKGROUND AND PRIOR ART

Recently the trend in detergent powders for fabric washing has been towards "concentrated" products requiring an ever smaller volume dose of powder per wash: this has been achieved by increasing bulk density. Meanwhile, the consumer's demand for good detergency performance, especially on oily soils, has continued to increase.

Modern high performance washing powders generally rely for oily soil detergency on the use of ethoxylated nonionic surfactants, for example, $C_{10-15}$ aliphatic alcohols ethoxylated with 2 to 10 moles of ethylene oxide per mole of alcohol. These surfactants are mobile liquids at ambient temperature and, for successful incorporation into a detergent powder, require inorganic carrier materials of high carrying capacity. The amount of these ethoxylated surfactants that can be incorporated is therefore limited by the amount that can be carried by the inorganic components of the formulation without bleeding out of the surfactant or loss of powder flow. Such limitations are especially stringent for high bulk density products in which the porosity of the inorganic materials is lower.

Most products contain a combination of anionic and nonionic surfactants to give optimum detergency over a range of soils and wash conditions. Anionic surfactants, such as alkylbenzene sulphonates and primary alcohol sulphates, are generally easier to incorporate at high levels in powders than are ethoxylated nonionic surfactants. However, these materials require inorganic salts in the formulation to provide the necessary ionic strength in the wash liquor to enable them to function at maximum efficiency. They also require detergency builders to bind calcium water hardness ions in the wash liquor.

With conventional surfactant systems, therefore, there is always a requirement for a relatively high level of inorganic material. Conventional products therefore tend to contain high levels of inorganic builder salts, whether water-soluble (for example, sodium tripolyphosphate) or water-insoluble (for example, alkali metal aluminosilicates such as zeolite A), which function simultaneously as calcium binders, carrier materials, and providers of ionic strength in the wash liquor. Because of this requirement it has been difficult or impossible to produce even more concentrated powder products containing extremely high levels of surfactant.

The present invention represents a different approach to the attempt to achieve more highly concentrated powder products. The compositions of the invention are based on the use of very high levels of a nonionic surfactant which is solid at ambient temperature, and therefore does not require an inorganic carrier; and which because it is nonionic does not require high levels of salts to generate a high ionic strength in the wash. Furthermore, the solid nonionic surfactant can itself act as a carrier for liquid nonionic surfactant, to give a very high total concentration of nonionic surfactant. The compositions of the invention also preferably contain only low levels of water-insoluble builders, or none at all.

Solid nonionic surfactacts that are useful in the compositions of the invention include, in particular, alkylpolyglycosides (APGs).

WO 93 19155A (Henkel) discloses the preparation of APG granulates containing high levels of APG in conjunction with inorganic carrier materials. These may be products in their own right but are primarily intended as intermediates in the production of more complex detergent powders. All the granulates exemplified contain substantial levels of zeolite.

WO 93 23514A (Henkel) discloses surfactant premixes in powder form, comprising APG (up to 40 wt. %), alkyl sulphate and inorganic carrier, preferably prepared by spray-drying. There is no disclosure of high bulk density concentrated detergent powders.

EP 474 915A (Hüls) discloses detergent powder compositions containing APGs in combination with ethoxylates. However, the upper limit for APG content is 30 wt. %.

EP 374 702A (Kao) discloses compositions, which may be liquid or particulate, containing APG, sulphonate or sulphate type anionic surfactant, amine oxide, and ethoxylated nonionic nonionic surfactant. The highest APG content exemplified (Example 5) is 25 wt. %, used together with 5 wt. % of 4EO ethoxylated alcohol, in a liquid composition.

WO 92 06164A (Procter & Gamble) discloses detergent compositions containing a different solid nonionic surfactant, polyhydroxyamide (PHA), in combination with a polycarboxylate detergency builder. Other surfactants that may be present include APG. High bulk density powders are disclosed. However, no compositions containing high levels of these nonionic surfactants are disclosed.

DEFINITION OF THE INVENTION

The present invention provides a particulate detergent composition comprising:

(a) from 40 to 90 wt. % of a nonionic surfactant component comprising:

(a1) 55 to 100 wt. % (based on the nonionic surfactant component) of a nonionic surfactant solid at ambient temperature, (a2) optionally 0 to 45 wt. % (based on the nonionic surfactant component) of a nonionic cosurfactant which may be solid or liquid at ambient temperature;

(b) optionally an anionic, cationic, amphoteric or zwitterionic cosurfactant which may be solid or liquid at ambient temperature, the ratio of (b) to (a) not exceeding 0.2:1, provided that the total amount of surfactant liquid at ambient temperature does not exceed 25 wt% of the total composition;

(c) a builder component comprising:

(c1) a water-soluble organic detergency builder together with a water-soluble inorganic builder or non-builder salt, or (c2) a water-soluble inorganic detergency builder, optionally together with a water-soluble inorganic non-builder salt, the ratio of (c) to (a) being within the range of from 0.1:1 to 1:1;

optionally plus minor detergent ingredients to 100 wt. %, the composition containing not more than 10 wt. % of water-insoluble inorganic builder, and not more than 10 wt. % of water.

DETAILED DESCRIPTION OF THE INVENTION

The Surfactant System

The compositions of the invention contain a nonionic surfactant component (a) which consists either wholly or predominantly of a nonionic surfactant (a1) which is solid at ambient temperature; optionally a lesser amount of a nonionic cosurfactant (a2) may also be present, the solid nonionic surfactant then acting as a carrier material for the liquid nonionic surfactant. Optionally also a minor amount of a cosurfactant (b) other than a nonionic surfactant may be present.

The total amount of the nonionic surfactant component (a) present is preferably from 50 to 90 wt. %.

Preferably the nonionic surfactant component (a) comprises from 60 to 100 wt. % of the solid nonionic surfactant (a1), and from 0 to 40 wt. % of the optional nonionic cosurfactant (a2).

The Solid Nonionic Surfactant (a1)

The compositions of the invention are characterised by a very high level of a nonionic surfactant component which consists wholly or predominantly of a nonionic surfactant which is solid at ambient temperature. Because this principal surfactant is nonionic, there is no need for high levels of detergency builders in the formulation, because nonionic surfactants are less sensitive to water hardness ions (notably calcium ions) than are anionic surfactants; and the requirement for sufficient electrolyte to provide high ionic strength in the wash liquor is also much lower than for anionic surfactants.

Because this principal surfactant is solid at ambient temperature, high levels of inorganic carrier materials are not required. The solid nonionic surfactant can itself behave as a carrier, enabling additional, liquid, nonionic surfactant to be incorporated giving an even higher total surfactant loading. The choice of a solid nonionic surfactant therefore reduces the amount of inorganic material necessary in the formulation, and allows for a very high level of surfactants to be incorporated.

The amount of solid nonionic surfactant (a1) present in the composition of the invention preferably comprises from 35 to 90 wt. %, more preferably from 50 to 90 wt. %.

Suitable solid nonionic surfactants for use in the compositions of the invention include the following:

- alkylpolyglycosides, for example, as disclosed in EP 75 995A (Procter & GambLe), EP 238 638B (Staley/Henkel), EP 487 262A (Unilever) and EP 374 702A (Kao);
- aldonamides, in particular, gluconamides and lactobionamides, for example, as disclosed in EP 550 278A (Unilever);
- polyhydroxyamides, for example, aidamides such as N-methylglucamide as disclosed in WO 92 06164A (Procter & Gamble); and
- glycolipids, for example, sophorose lipids, as disclosed in EP 499 434A (Unilever).

Other solid nonionic surfactants suitable for use in the present invention include alkyl glycerates; alkylidene sugar derivatives, for example, alkylidene glucose; sugar esters, for example, glucose and sucrose esters; alkanoyl glucoside esters, for example, methyl glucoside ester; alkyl mono- and diethanolamides. This list is not intended to be exhaustive.

Some of these materials, notably alkylpolyglycosides, although inherently solid at ambient temperature, are presently commercially available only as aqueous solutions. However, these solutions may readily be dried to give solids.

Alkylpolyglycosides

Especially preferred are alkylpolyglycosides, which may be represented by the general formula I $$RO(R'O)_t(G)_x \quad (I)$$

in which R is an organic hydrophobic residue containing 10 to 20 carbon atoms, R' is an alkylene group contains 2 to 4 carbon atoms, G is a saccharide residue containing 5 or 6 carbon atoms, t is within the range of from 0 to 25 and x is within the range of from 1 to 10.

The hydrophobic group R is preferably aliphatic, either saturated or unsaturated, notably straight or branched alkyl, alkenyl, hydroxyalkyl or hydroxyalkenyl. However, it may include an aryl group, for example, alkyl-aryl, alkenyl-aryl and hydroxyalkyl-aryl. Particularly preferred is that R is an alkyl or alkenyl group having from 8 to 16 carbon atoms. Most preferred is that R is an alkyl group having from 12 to 14 carbon atoms.

The value of t in the general formula above is preferably zero, so that the —$(RO)_t$— unit of the general formula is absent. In that case the general formula becomes II:

$$RO(G)_x \quad (II)$$

If t is non-zero it is preferred that R'O is an ethylene oxide residue. Other likely possibilities are propylene oxide and glycerol residues. If the parameter t is non-zero so that R'O is present, the value of t (which may be an average value) will preferably lie within the range of from 0.5 to 10.

The group G is typically derived from fructose, glucose, mannose, galactose, talose, gulose, allose, altrose, idose, arabinose, xylose, lyxose and/or ribose. Preferably, the group G is provided substantially exclusively by glucose units.

The value x, which is an average, is usually termed the degree of polymerisation (dp). Desirably x is within the range of from 1 to 8. Preferred values of x lie within the range of from 1 to 3, more especially from 1 to 2.

When x lies in the range of from 1 to 2 it is preferred that R is $C_8$ to $C_{14}$ alkyl or alkenyl. Commercially available products suitable for use in the compositions of the invention include Glucopon 600 CS UP (C12–C14 alkyl, dp 1.4), and APG 600 EC and 650 EC, all ex Henkel KGaA;. Lutensol (Trade Mark) GD 70 ex BASF; Marlosan (Trade Mark) 24 ex Hüls; and Atlas (Trade Mark) G73500 ex ICI. As previously indicated, these materials are presently only sold in aqueous solution form, but may readily be dried to solids.

When the solid nonionic surfactant (a1) is an alkylpolyglycoside, it is preferably present in an amount of from 60 to 90 wt. %. Alkylpolyglycosides may be used with or without a nonionic cosurfactant (a2).

Aldonamides

Alternative solid surfactants useful in the compositions of the invention are aldonamides, and more especially the aldobionamides described and claimed in EP 550 278A (Unilever). Aldobionamides are materials having the structure III:

$$ANR_1R_2 \quad (III)$$

wherein A is a sugar moiety which is an aldobionic acid except that it does not contain the OH group normally extending from the carbonyl group on the aldobionic acid; $NR_1R_2$ is attached where the hydroxyl group on the aldobionic acid would normally be found; and $R_1$ and $R_2$ are the same or different and are hydrogen atoms, aliphatic radicals, aromatic radicals, cycloaliphatic radicals, amino acid esters, ether amines and combinations thereof, except that $R_1$ and $R_2$ cannot both be hydrogen atoms. Preferably, one of $R_1$ and $R_2$ is hydrogen and the other is an alkyl group having from 8 to 24 carbon atoms; and A is a disaccharide residue (minus the hydroxy group).

Especially preferred are lactobionamides and maltobionamides, more preferably lactobionamides in which one R group is hydrogen and the other is $C_{10-14}$ alkyl. Most preferred is coco-lactobionamide.

When the solid nonionic surfactant (a1) is a lactobionamide, it is preferably present in an amount of from 30 to 90 wt. %. Lactobionamides are preferably used in conjunction with a nonionic cosurfactant (a2), suitably present in an amount of from 10 to 30 wt. %.

The Nonionic Cosurfactant (a2)

If required or desired, the compositions of the invention may contain a nonionic cosurfactant in order to boost detergency.

When the principal surfactant is alkylpolyglycoside, good detergency performance may be obtained without the use of a nonionic cosurfactant. However, some other nonionic surfactants, for example, lactobionamides, may require the use of a nonionic cosurfactant to give optimum detergency over the full range of soils and wash conditions.

It is not necessary for the nonionic cosurfactant to be solid at ambient temperature, since it constitutes at most 45 wt. % of the nonionic surfactant component, preferably at most 40 wt. %. The nonionic cosurfactant is suitably present in an amount of from 10 to 30 wt. % based on the total composition.

Suitable nonionic cosurfactants include ethoxylated alcohols, especially $C_{10-20}$ alcohols ethoxylated with 2 to 20 moles of ethylene oxide per mole of alcohol. Especially preferred are ethoxylated alcohols of low HLB value, for example, $C_{10-15}$ alcohols ethoxylated with 2 to 10 moles of ethylene oxide per mole of alcohol. A preferred nonionic cosurfactant has a hydrophilic/lipophilic balance (HLB) value which does not exceed 13.0.

The Additional Cosurfactant (b)

In addition to the nonionic surfactant component (a), the compositions of the invention may contain a minor amount of a cosurfactant of a charge type other than nonionic, namely, anionic, cationic, amphoteric or zwitterionic.

The weight ratio of the cosurfactant (b) to the nonionic surfactant component (a) should not exceed 0.2:1 and preferably does not exceed 0.1:1, and may suitably lie within the range of from 0.01:1 to 0.05:1.

However, if the cosurfactant (b) is a liquid at ambient temperature, the amount that may be incorporated may be more limited, as is the case for the nonionic cosurfactant (a2). The total amount of surfactant of any charge type that is not solid at ambient temperature should not exceed 25 wt. % of the total composition.

Examples of suitable cosurfactants include alkylbenzene sulphonates, primary and secondary alkyl sulphates, alkyl ether sulphates, alkyl ether carboxylates, taurates, isethionates, betaines, and amine oxides.

Preferred cosurfactants are calcium insensitive and act as calcium soap dispersants. Examples of such surfactants include alkyl ether sulphates, alkyl ether carboxylates, taurates, isethionates, betaines, and amine oxides, of which amine oxides are preferred, and alkyl ether sulphates and alkylamidopropyl betaines are especially preferred.

The Deterqency Builder System

The builder system of the compositions of the invention is based on the use of water-soluble builders. Preferably water-insoluble builders such as alkali metal aluminosilicates (zeolites) are absent. Although capable of giving very low residual calcium ion levels, zeolite is a slow builder and is therefore not a good choice for products intended for low wash temperatures and/or in short wash time regimes. Its insolubility also tends to hinder the dispersion and dissolution of the product as a whole in the wash.

If present, water-insoluble detergency builders such as alkali metal aluminosilicates should not exceed 10 wt. % of the total composition. Preferably they are absent.

The total amount of builder is generally low in comparison with the levels used in conventional products. Preferably the total amount of builder component (c) is within the range of from 10 to 50 wt. %, more preferably from 10 to 45 wt. %.

The ratio of total builder (c) to the nonionic surfactant component (a) is within the range of from 0.1:1 to 1:1, preferably from 0.5:1 to 0.8:1.

The water-soluble builders used according to the invention may be organic or inorganic. Two alternative systems have been identified:

(c1) the use of a water-soluble organic builder, in combination with a water-soluble inorganic salt which may be a builder or a non-builder; or (c2) the use of a water-soluble inorganic builder.

Thus, if the main builder is organic, the presence of an inorganic salt is also required; while an inorganic water-soluble builder may be used alone. However, in case (c2) a second water-soluble salt may if desired be present.

The total amount of inorganic builders and salts preferably does not exceed 30 wt. %. It is preferably within the range of from 10 to 30 wt. %, more preferably from 10 to 25 wt. %.

The preferred water-soluble inorganic detergency builder is alkali metal, preferably sodium, carbonate. Sodium carbonate is also preferred as a salt for use in combination with a polymeric detergency builder.

Preferred water-soluble organic builders are polymeric, for maximum weight effectiveness. Especially preferred are polycarboxylate polymers, such as homopolymers and copolymers of acrylic acid, maleic acid, or iraconic acid. Polymers that may be used include polyacrylates, acrylic/maleic copolymers such as Sokalan (Trade Mark) CP5 and CP7 ex BASF, and the polyvinyl acetate/polyitaconic acid polymers described and claimed in WO 93 23444A (Unilever). This list is not intended to be exhaustive. Polymeric builders are suitably used in an amount of from 10 to 25 wt. %, preferably from 15 to 25 wt. %.

Thus, preferred compositions of the invention contain, as a builder system, either a polycarboxylate polymer in combination with sodium carbonate, or sodium carbonate alone.

Powder Structurant

Advantageously a powder structurant material capable of structuring the crystal network of the powder may be present. The presence of a structurant is of especial value when a cosurfactant that is not a solid at ambient temperature is present. The structurant may suitably be present in an amount of from 1 to 10 wt. %, preferably from 3 to 8 wt. %.

An especially preferred structurant is a salt (soap) of a $C_8$–$C_{22}$ fatty acid, preferably an alkali metal soap and especially a sodium soap.

Other Optional Ingredients

The compositions of the invention may contain minor amounts of other usual detergent ingredients, for example, fluorescers, and antiresoiling and antiredeposition polymers.

Water Content

It is an important feature of the compositions of the present invention that the water content be as low as possible, preferably not more than 10 wt. %, more preferably not more than 5 wt. % and desirably not more than 2 wt. %. Water takes up valuable formulation space which cannot be spared in the highly concentrated compositions of the present invention. Preferred compositions of the invention are substantially anhydrous.

Base Powders and Fully Formulated Powders

The compositions of the invention may be regarded as fully formulated powders in their own right.

They may alternatively be regarded as base powders to which may be admixed other particulate components, possibly in more substantial amounts, to give fully formulated products offering additional functional benefits, as is conventional in detergent powder production. Examples of such admixed components include bleach compounds, bleach precursors and bleach stabilisers; enzyme granules; foam control granules; coloured speckles; perfumes; and fabric softening compounds. This list is not intended to be exhaustive.

Bulk Density

Preferred compositions of the invention have bulk densities of at least 600 g/liter. The higher the bulk density, the smaller the volume dose of powder required per wash. However, this is not essential, since the improvement in detergency performance achieved by means of the invention in any case allows a smaller dose by weight per wash to be used.

Preparation of the Detergent Compositions

The compositions of the invention may be prepared by any suitable processes. Since the compositions are of low water content, processes which do not introduce water beyond that present in the ingredient raw materials are generally preferred.

Preferred processes may use particulate starting materials where possible: examples of such processes are dry mixing and granulation. However, methods involving pastes, doughs or melts may also be used. Examples of possible processes include the following:

- solid surfactant may be milled with or without other components to give particles of appropriate size;
- a melt may be spray-cooled to give prills;
- a melt may be subjected to a pastillation-type process in which drops of the melt are applied to chilled moving belts or drums;
- a melt may be applied to a chilled roll press and the solidified melt scraped off to give flakes or other small particles;
- from a melt or solution, a scraped surface heat exchanger may be used to evaporate any solvent or water which may be present and dry the material, which is then scraped off to give flakes or other small particles;
- surfactant and optionally other components may be mixed and extruded under pressure and a suitable temperature to form small particles;
- solid components may granulated using a liquid binder, preferably a liquid surfactant or other functional component;
- an aqueous slurry of the principal components may be spray dried; the resulting powder may optionally be further processed, possibly involving further granulation or densification.
- Particles formed in any process may be spheronised or further granulated (possibly with the addition of other components) in a separate process if desired.
- In any process, water content may be reduced by incorporating a fluid bed drying step.
- The processes outlined above may be used to produce a fully formulated, finished detergent powder, or alternatively a base powder to which other components may be postdosed, notably process sensitive materials or separately prepared ingredients.

EXAMPLES

The invention is further illustrated by the following non-limiting Examples, in which parts and percentages are by weight unless otherwise-stated. Examples designated by figures are in accordance with the invention, while Examples designated by letters are comparative.

Examples 1 and 2, Comparative Examples A and B

Two compositions were prepared to the following formulations (in anhydrous wt. %):

| | 1 | 2 |
|---|---|---|
| (a) APG ($C_{12-14}$, dp 1.4)* | 83 | 66 |
| (c1) Acrylic/maleic polymer** | — | 17 |
| Sodium carbonate | — | 17 |
| (c2) Sodium carbonate | 17 | — |

*Glucopon (Trade Mark) 600 CS UP ex Henkel KGaA
**Sokalan (Trade Mark) CP5 ex BASF The detergency of the composition of Example 1 at a product dose of 0.5 g/l was compared, in the Tergotometer, with the detergencies at 0.5 g/l (Comparative Example A) and 1.0 g/l (Comparative Example B) of a comparative powder having the following formulation:

| | |
|---|---|
| Linear alkylbenzene sulphonate | 27.8 |
| Primary alcohol sulphate (cocoPAS) | 1.3 |
| Nonionic surfactant ($C_{12-15}$, 11EO) | 1.0 |
| Tallow soap | 1.1 |
| Sodium carbonate (anhydrous) | 13.7 |
| Sodium sulphate (anhydrous) | 5.5 |
| Sodium alkaline silicate | 5.0 |
| Zeolite 4A | 43.7 |

This formulation is typical of commercial products on sale in Japan and other Far Eastern countries. The normal recommended dose for such commercial powders is approximately 1.0 g/liter, in Japan, and may be higher in other countries.

The experimental conditions were as follows: 1 liter of wash liquor containing $5\times10^{-4}$ mole calcium chloride and $2\times10^{-4}$ mole magnesium chloride; 40 g of cloth (test cloth plus cotton ballast) per wash; 10 minute wash at 25° C. and 70 oscillations per minute.

Detergencies were assessed by measuring the difference in reflectance at 420 nm of test cloths before and after washing. Reflectances were measured using a "Micro-Match" (Trade Mark) reflectance spectrophotometer (Instrumental Colour Systems Ltd, UK) calibrated using white, grey and black standards of known reflectance. The light source was a xenon arc lamp: incident light had wavelengths below 420 nm filtered out and the reflectance measurements were made at a wavelength of 460 nm.

Three different test cloths were used, as follows:

Test Cloth 1: WFK 10D (kaolin and sebum on cotton)
Test Cloth 2: WFK 30D (kaolin and sebum on polyester)
Test Cloth 3: WFK 30C (kaolin and woolfat on polyester)

The results, expressed as reflectance differences at 460 nm, were as follows:

| Example | A | B | 1 | Standard Deviation |
|---|---|---|---|---|
| Dosage | 0.5 g/l | 1.0 g/l | 0.5 g/l | |
| Test Cloth 1 | 9.08 | 13.43 | 8.57 | 0.47 |
| Test Cloth 2 | 6.91 | 7.92 | 9.60 | 0.54 |
| Test Cloth 3 | 3.04 | 5.00 | 8.94 | 1.09 |
| Average | 6.34 | 8.78 | 9.04 | |

It will be seen that the formulation of Example 1, used at a dosage of 0.5 g/liter, matched the performance of the comparative powder used at twice the dose.

Example 3

A composition according to the invention was prepared to the following formulation (in anhydrous wt. %):

| | |
|---|---|
| (a) APG ($C_{12-14}$, dp 1.4) (as Example 1) | 66 |
| (c1) Acrylic/maleic polymer* | 17 |
| Sodium carbonate | 17 |

*W72312 ex Hüls, a terpolymer of acrylic acid, maleic acid and vinyl alcohol.

The detergency of the composition of Example 3 at a product dose of 0.5 g/l was compared, in a washing machine test, with the detergency of the same comparative powder as used in Example 1 at its normal dosage of 1.0 g/l (Comparative Example C).

The test was carried out using a Japanese top-loading twin tub washing machine, under the following conditions:

wash liquor volume 35 liters water hardness $5\times10^{-4}$ M $Ca^{2+}$, $2\times10^{-4}$ M $Mg^{2+}$ wash temperature 20° C.

wash time 10 minutes, two 2-minute rinses.

Each wash load consisted of clean cotton ballast (2 kg) plus four pieces of each test cloth:

Test Cloth 1: WFK 10D (kaolin and sebum on cotton)
Test Cloth 2: WFK 30D (kaolin and sebum on polyester)
Test Cloth 3: WFK 30C (kaolin and woolfat on polyester)
Test Cloth 4: oil, silica and ink on cotton
Test Cloth 5: WFK 20D (kaolin and sebum on polyester/cotton)

The products for testing (Example 3 and Comparative Example C) were predissolved in 1 liter of water and poured into the machine at the start of the wash. Each product was tested three times and the results averaged.

The results, expressed as reflectance differences at 460 nm, were as follows:

| Example | C | 3 |
|---|---|---|
| Dosage | 1.0 g/l | 0.5 g/l |
| Test Cloth 1 | 20.02 | 18.45 |
| Test Cloth 2 | 15.01 | 17.51 |
| Test Cloth 3 | 14.79 | 19.43 |
| Test Cloth 4 | 19.37 | 17.35 |
| Test Cloth 5 | 20.87 | 23.61 |
| Average | 18.01 | 19.27 |

Examples 4 and 5

Compositions of the invention containing lactobionamide were prepared to the following formulations (in anhydrous wt. %) :

| | 4 | 5 |
|---|---|---|
| (a1) Cocolactobionamide* | 35 | 33.3 |
| (a2) Nonionic cosurfactant** | 21 | 20.0 |
| (c1) Acrylic/maleic copolymer*** | 19 | 18.0 |
| Sodium carbonate | 25 | 23.7 |
| Sodium stearate (structurant) | — | 5.0 |

*as in Example 12 of EP 550 278A (Unilever)
**coconut ($C_{12-14}$) alcohol 3EO ethoxylate
***Sokalan CP5 ex BASF The formulations produced fine free-flowing granules in a size range (100–1500 micrometres) suitable for application in particulate detergent products. The formulations remained free-flowing after prolonged storage in closed bottles.

We claim:

1. A particulate detergent composition comprising:

(a) from 50 to 90 wt. % of a nonionic surfactant component comprising:

(a1) 55 to 100 wt. % based on the nonionic suffactant component of a nonionic surfactant solid at ambient temperature, selected from the group consisting of gluconamides, lactobionamides, other aldonamides, sophorose lipids, and aldamides, (a2) optionally 0 to 45 wt. % based on the nonionic surfactant component of a nonionic cosurfactant which may be solid or liquid at ambient temperature, (b) optionally an anionic, cationic, amphoteric or zwitterionic cosurfactant which may be solid or liquid at ambient temperature, the ratio of (b) to (a) being not greater than 0.2:1, provided that the total amount of suffactant liquid at ambient temperature present does not exceed 25 wt. % of the total composition;

(c) a builder component comprising:

(c2) a water-soluble organic detergency builder together with a water-soluble inorganic builder or non-builder salt, or (c2) a water-soluble inorganic detergency builder, optionally together with a water-soluble inorganic non-builder salt, the ratio of(c) to (a) being within the range of from 0.1:1 to 1:1; optionally plus minor detergent ingredients to 100 wt. %, the composition containing not more than 10 wt. % of water-insoluble inorganic builder and not more than 10 wt. % of water and being free from alkali metal aluminosilicate.

2. A detergent composition as claimed in claim 1, wherein the nonionic surfactant component (a) comprises from 60 to 100 wt. % of the solid nonionic surfactant (a1) and from 0 to 40 wt. % of the nonionic cosurfactant (a2).

3. A detergent composition as claimed in claim 1, which contains from 50 to 90 wt. % of the solid nonionic surfactant (a1) .

4. A detergent composition as claimed in claim 1, wherein the nonionic cosurfactant (a2) is an ethoxylated alcohol having an HLB value not exceeding 13.0.

5. A detergent composition as claimed in claim 1, wherein the nonionic cosurfactant (a2) is present in an amount of from 10 to 30 wt. %.

6. A detergent composition as claimed in claim 1, wherein the optional cosurfactant (b) is selected from alkyl ether sulphates, alkylamidopropylbetaines, and amine oxides.

7. A detergent composition as claimed in claim 1, wherein the ratio of the builder component (c) to the nonionic surfactant component (a) is within the range of from 0.5:1 to 0.8:1.

8. A detergent composition as claimed in claim 1, wherein the ratio of cosurfactant (b) to the nonionic surfactant component (a) is within the range of from 0.01:1 to 0.1:1.

9. A detergent composition as claimed in claim 1, wherein the total amount of builder component (c is within the range of from 10 to 50 wt. %.

10. A detergent composition as claimed in claim 9, wherein the total amount of builder component (c) is within the range of from 10 to 45 wt. %.

11. A detergent composition as claimed in claim 1, wherein the total amount of inorganic builders and salts present is within the range of from 10 to 30 wt. %.

12. A detergent composition as claimed in claim 11, wherein the total amount of inorganic builders and salts present is within the range of from 10 to 25 wt. %.

13. A detergent composition as claimed in claim 1, wherein the builder component (c) comprises sodium carbonate as a water-soluble inorganic builder salt (c1 or c2).

14. A detergent composition as claimed in claim 1, wherein the builder component (c) comprises an organic detergency builder (c1) which is a polycarboxylate polymer.

15. A detergent composition as claimed in claim 14, wherein the polymer comprises a homo- or copolymer of acrylic acid and/or maleic acid.

16. A detergent composition as claimed in claim 14, wherein the polymer is present in an amount within the range of from 10 to 25 wt. %.

17. A detergent composition as claimed in claim 14, wherein the polymer is present in an amount of from 15 to 25 wt. %.

18. A detergent composition as claimed in claim 1, having a bulk density of at least 600 g/liter.

19. A detergent composition as claimed in claim 1, which is free from water-insoluble inorganic builder.

20. A detergent composition as claimed in claim 1, having a water content not exceeding 5 wt. %.

21. A detergent composition as claimed in claim 20, having a water content not exceeding 2 wt. %.

22. A detergent composition as claimed in claim 20, which is substantially anhydrous.

* * * * *